US008708846B2

(12) United States Patent
Hisle, Jr. et al.

(10) Patent No.: US 8,708,846 B2
(45) Date of Patent: Apr. 29, 2014

(54) GRIP FOR SPORTING EQUIPMENT, METHOD OF USING A GRIP FOR SPORTING EQUIPMENT, AND METHOD OF FORMING A GRIP FOR SPORTING EQUIPMENT

(75) Inventors: Larry Eugene Hisle, Jr., Mequon, WI (US); Larry Eugene Hisle, Mequon, WI (US)

(73) Assignee: The Hit Syndicate LLC, Mequon, WI (US)

( * ) Notice: Subject to any disclaimer, the term of this patent is extended or adjusted under 35 U.S.C. 154(b) by 95 days.

(21) Appl. No.: 12/633,293

(22) Filed: Dec. 8, 2009

(65) Prior Publication Data

US 2010/0151975 A1 Jun. 17, 2010

Related U.S. Application Data

(60) Provisional application No. 61/162,713, filed on Mar. 24, 2009, provisional application No. 61/120,908, filed on Dec. 9, 2008.

(51) Int. Cl.
*A63B 59/06* (2006.01)

(52) U.S. Cl.
USPC ..... 473/568

(58) Field of Classification Search
USPC ..... 473/457, 519, 520, 564–568
See application file for complete search history.

(56) References Cited

U.S. PATENT DOCUMENTS

| | | | | | |
|---|---|---|---|---|---|
| 2,775,455 | A * | 12/1956 | Liberti | 473/568 |
| 4,653,754 | A * | 3/1987 | Cross | 473/568 |
| 5,427,376 | A * | 6/1995 | Cummings et al. | 473/201 |
| 5,482,270 | A * | 1/1996 | Smith | 473/568 |
| 5,577,722 | A * | 11/1996 | Glassberg | 473/457 |
| 5,839,983 | A * | 11/1998 | Kramer | 473/568 |
| 6,305,051 | B1 * | 10/2001 | Cho | 16/430 |
| 6,872,157 | B2 * | 3/2005 | Falone et al. | 473/568 |
| 7,125,353 | B2 | 10/2006 | Blount | |
| 7,351,167 | B1 * | 4/2008 | Hathaway | 473/457 |
| 2005/0272537 | A1 * | 12/2005 | Kramer | 473/568 |
| 2007/0254753 | A1 * | 11/2007 | Bleecker | 473/568 |
| 2008/0032831 | A1 * | 2/2008 | Schroeder | 473/464 |
| 2008/0200288 | A1 * | 8/2008 | Phelan | 473/568 |
| 2009/0312125 | A1 * | 12/2009 | Kearns | 473/451 |
| 2011/0039642 | A1 * | 2/2011 | Phelan, Jr. | 473/568 |

* cited by examiner

*Primary Examiner* — Mark Graham
(74) *Attorney, Agent, or Firm* — K&L Gates LLP

(57) ABSTRACT

A grip for a piece of sporting equipment has a unitary body formed from a relatively flexible material. The grip includes a pair of gripping surfaces comprising a plurality of slots for receiving a users fingers. The gripping surfaces are offset to ensure that the user properly grips the piece of sporting equipment to maximize power and control of the equipment. By maintaining proper positioning from setup through follow through of a swing, proper energy transfer from the large muscles of the user's body to the equipment is accomplished. Impact-based injuries and repetitive injuries are minimized, and pain associated with certain swings is minimized. The grip may be formed from an impression of a user's grip, from which a grip mold is formed. The grip mold is positioned around the handle of an actual bat, filled with urethane, and allowed to cure into the disclosed grip.

8 Claims, 4 Drawing Sheets

GRIP FOR SPORTING EQUIPMENT, METHOD OF USING A GRIP FOR SPORTING EQUIPMENT, AND METHOD OF FORMING A GRIP FOR SPORTING EQUIPMENT

PRIORITY CLAIM

This application is a non-provisional application of, claims priority to and the benefit of U.S. Provisional Patent Application No. 61/120,908, filed Dec. 9, 2008, and is also a non-provisional application of, claims priority to and the benefit of U.S. Provisional Patent Application No. 61/162,713, filed Mar. 24, 2009, the entire contents of which are incorporated herein by reference.

TECHNICAL FIELD

The present disclosure relates to sporting equipment, and more specifically, to an improved grip for a piece of sporting equipment such as a baseball bat, golf club, tennis racket or other such equipment.

BACKGROUND

A number of grips exist for instructing a user on how to properly grip a baseball bat, golf club, tennis racket, or other similar such sporting equipment.

Grips specifically configured for instructing an individual as to how to properly grasp the equipment are generally known in the art. For example, U.S. Pat. No. 7,125,353 to Blount discloses a baseball bat grip that encourages a user of the grip to maintain a proper grip throughout the entire swing of the baseball bat. The grip includes a pair of protrusions that are secured between a V-shaped opening between the user's index finger and thumb on each hand. The grip further includes certain ridges and valleys configured to receive the user's fingers to further maintain an appropriate grip.

Such grips suffer from a number of disadvantages. In particular, these grips do not properly instruct a user on how to position the baseball bat such that when the user swings the baseball bat, the so-called trademark portion of the bat is positioned correctly with respect to the user's hands and with respect to the batted ball. Further, the grip of the '353 patent suffers other disadvantages, namely, the V-shaped openings formed by the protrusions result in a grip that rests too deeply into the user's hand, thus requiring that the user control the bat with the palm of the user's hand instead of the fingers of the user's hand. Further, the ridges and valleys do not conform to the user's hand or instruct the user on where to position each of the user's respective fingers on the baseball bat. In addition, the '353 patent is configured to instruct a user on how to achieve a "knocked knuckles" grip throughout the swing. Such a "knocked knuckles" grip, however, is can be disadvantageous because the "knocked knuckles" grip significantly reduces a user's ability to securely grasp the baseball bat and swing the bat in a controlled, powerful manner.

A number of other training aids exist for instructing a user on the proper way in which to grasp a piece of sporting equipment. For example, gloves that have visual indicators for instructing an individual on the proper way in which to hold a baseball bat or golf club are well known in the art. However, while such devices provide an individual with a visual guide or indication as to the proper setup position of the user's hands, such devices do not provide the individual with feedback as to whether the appropriate hand positioning is maintained during the actual swinging or use of the sporting equipment, and thus, such devices do not promote the teaching of proper muscle memory.

Finally, certain training aids, including grips for sporting equipment, cannot be easily installed on the sporting equipment due to the shape of such equipment. Specifically, a baseball bat typically includes a knob at a first end, a barrel at a second end, and a handle portion between the knob and the barrel. The user grips the baseball bat at the handle portion, and as such training aids for teaching and promoting proper grip are installed on the handle portion. The knob and barrel, however, are typically larger in diameter than the handle portion. Thus, installing a grip known in the art is difficult, as the grip must be stretched over the knob, yet retain a tight fit to the handle portion.

Thus, there exists a need to provide a sports grip that overcomes the aforementioned problems.

SUMMARY

In one embodiment, a grip for a piece of sporting equipment such as a baseball bat or a golf club includes a generally unitary body. In one embodiment, the body includes a pair of gripping surfaces having a number of slots for receiving the user's fingers. In one embodiment, the gripping surfaces are specifically contoured to receive the user's fingers such that when the user grasps the gripping surfaces with his or her hands, the user's hands are retained in a desired position (i.e., a proper gripping position for the particular piece of equipment). The gripping surfaces are specifically configured to maintain the user's hands in the proper gripping position throughout the entirety of the swing, (i.e., from set-up to follow through). In one embodiment, the slots of the gripping surfaces are deep enough to secure the user's fingers within the slots to prevent accidental slippage of the grasped sporting equipment.

In one embodiment, the body of the grip disclosed herein includes a heel portion. In one such embodiment, the heel portion is ergonomically shaped and positioned at a first, proximal end of the body of the grip. In one embodiment, the proximal end of the grip (including the heel portion of the grip) is positioned at a proximal end of the bat, near a knob of the bat. In a further embodiment, the heel portion of the grip is positioned opposite a plurality of gripping surfaces of the grip.

In one embodiment, the grip disclosed herein includes a knob portion positioned at an upper surface of the body of the grip. In one such embodiment, the upper surface of the body of the grip is at the distal end of the grip. In one embodiment, the knob portion prevents a user's hands from slipping from a desired grip position.

In one embodiment, the knob portion additionally includes position indicating means, such as one or more demarcations, for instructing a user on how to position the grip on the piece of sporting equipment. In one such embodiment, the position indicating means instruct the user how to position the grip with respect to a trademark portion of the piece of sporting equipment.

In one embodiment, the body of the grip disclosed herein is constructed from a relatively flexible and/or moldable material. In one such embodiment, the body of the grip is constructed from a urethane or polyurethane material. In other embodiments, the grip is constructed from a rubber-based substance, a memory material configured to retain the shape of particular user's hands, or any other suitable material.

In one embodiment, the grip disclosed herein is created by forming the grip directly onto the handle of a bat or other piece of sporting equipment. In this embodiment, an appropriate putty substance is applied to the handle of the bat or other piece of sporting equipment. After applying such putty, the user grips the handle of the bat through the putty, forming an impression. In one embodiment, the putty impression is left on the bat handle, and the remainder (i.e., barrel end) of the bat is cut or sawed off. In another embodiment, the handle of the bat is not cut or sawed off, and the bat on which the putty was applied remains in tact. In these embodiments, the handle/putty combination is appropriately mounted in a form. A liquid form of an appropriate molding substance, such as silicone rubber, is poured into the form and allowed to cure. In one embodiment, after the rubber cures, the form is cleaned and a grip mold is created.

In one embodiment, after having created a form specific to a particular user, the grip is formed around an actual handle of a bat or other piece of sporting equipment (i.e., a different bat than the one on which the putty was applied, such as one which has not been sawed off) by inserting the handle into a grip mold containing the form. In one such embodiment, prior to inserting the actual bat or other sporting equipment handle, the handle is scored or cross-hatched with an appropriate scoring tool, such that the grip does not move with respect to the bat handle. After the bat is inserted into the mold, the grip material (such as the urethane) is injected into the mold and allowed to cure as appropriate.

In one embodiment, the grip provides the user with improved bat control by securing the user's hands on the grip in a preferred grip position, and by preventing the user's hands from slipping from the preferred position during a swing of the bat. The grip is also generally configured to promote efficient power transfer during use. These objects are accomplished by providing a grip that is specifically configured to secure the user's hands in a preferred position during use.

In one embodiment, the grip is further configured to promote a plurality of health benefits and to reduce or prevent injuries suffered during single or repetitive use of certain sporting equipment. In one embodiment, the grip prevents injury by providing padding between the sporting equipment (i.e., a relatively hard surface) and the user's hands. In this embodiment, the grip prevents or reduces carpal injuries (including hook of the hamate-type injuries), metacarpal injuries, and phalanx contusions and fractures. Such injuries frequently occur in one of two ways: either through repetitive use of the bat (as is frequently experienced during a sporting season, such as a baseball or golf season), or through a player being struck by a ball or other projectile (such as would be experienced by a hit batsman). By providing a grip which secures position of the user's hands, and which provides a layer of padding between the player's hands and the sporting equipment, the grip in one embodiment reduces or prevents the above-noted injuries. In one embodiment, the grip further prevents pain experienced by a user when a batted ball is struck with an undesired portion of the bat that is, either an extreme distal end of the bat (e.g., the tip of the barrel of the bat) or an extreme proximal end of the bat (e.g., the handle of the bat, near the hands of the user). Users of bats without the grip disclosed herein frequently experience pain in the hands and forearms when making contact with a thrown ball on cold days, regardless of the point of contact on the bat. In one embodiment, the grip disclosed herein also prevents or eliminates the pain suffered during such cold-weather contact.

In one embodiment, as noted above, the grip disclosed herein promotes proper hand position and prevents a users hands from slipping during a swing of a bat. In this embodiment, the grip enables a user to swing a bat with less grip-strength throughout the swing. Such reduced grip strength in various embodiments reduces tension on the muscles of the hand, wrist, elbow, and shoulder, preventing overuse-related injury. For example, a user using the disclosed grip may experience reduction in injuries including epicondylitis (golfer's/tennis elbow) and flexor tendon strain. In addition, the muscles of the upper extremities (e.g., hand, wrist, elbow, and shoulder) are stronger and more fresh at the end of a season. In one embodiment, those unavoidable injuries suffered by users of the grip disclosed herein in conjunction with a bat require less rehabilitation that similar injuries suffered by users of a bat without the grip disclosed herein. It should be appreciated that in one embodiment, the grip disclosed herein prevents both instantaneous, impact-related injuries (e.g., fractures), as well as repetitive-use injuries suffered during the course of a season.

In one embodiment, the grip disclosed herein secures the bat in the hands of the user by providing the plurality of slots for the user's fingers. In this embodiment, the grip prevents the user from accidentally losing control of the bat during a swing. By preventing such loss of control, the grip disclosed herein reduces the incidence of injury to other players and spectators caused by thrown bats.

In another embodiment, use of the grip disclosed herein provides a user with greater control of a bat during a swing. In one embodiment, the grip enables the use to direct the path of the bat more precisely, and as such, to ensure better, more consistent contact with pitched balls. In such embodiments, the disclosed grip enables a user to more accurately direct batted balls and to achieve greater power with reduced effort.

In one embodiment, the gripping surfaces of the grip disclosed herein are positioned, sized, and configured to improve swing control, speed, and accuracy.

It is thus an object of the present disclosure to provide a grip that aids a user in the proper positioning of the grip on the piece of sporting equipment.

It is another object of the present disclosure to provide a grip configured to aid in the energy transfer generated by the large muscles of the user's body to the piece of sporting equipment.

It is also an object of the present disclosure to provide a grip including a plurality of gripping surfaces, the grip constructed or formed from a material configured to retain the shape of the user's hand such that the gripping surfaces are specific and customized to a particular user of the grip.

It is also an object of present disclosure to prevent the handle of the bat from entering and being held in the palm of the user. It is a further object of the present disclosure to provide surface in contact with the palm portion of the top hand of the user against which the top hand of the user can push during a swing of the bat. It is a further object of the present disclosure to provide a surface in contact with the palm portion of the bottom hand of the user on which the bottom hand of the user can pull during a swing of the bat. In one embodiment, the grip disclosed herein thus eliminates or substantially reduces wasted or unintentional movement to give the hitter improved bat speed and grip strength to immediately strike the ball.

It is another object of the present disclosure to provide a grip having means for preventing a user's hands from slipping from the grip. In one embodiment, such a means for preventing a user's hands from slipping from the grip includes, in part, the knob of the grip.

Another object of the present disclosure is to provide a grip configured to eliminate stinging sensations experienced by users when striking the ball, either correctly or incorrectly, during cold or inclement weather.

Another object of the present disclosure is to provide a grip configured to improve an individual's grip strength.

Another object of the present disclosure is to provide an ergonomically fitted grip to reduce user discomfort during use.

Another object of the present disclosure is to provide a grip configured to reduce or eliminate the development of bone bruises in the user's hands. In one embodiment, the grip is configured to eliminate bruises to the user's hamate bone.

Another object of the present disclosure is to eliminate or reduce hand fatigue during use.

Another object of the present disclosure is to provide a grip that eliminates the development of blisters and calluses commonly associated with repetitive use of a particular piece of sporting equipment.

Additional features and advantages are described herein, and will be apparent from the following Detailed Description and the figures.

DETAILED DESCRIPTION

Figure 1:
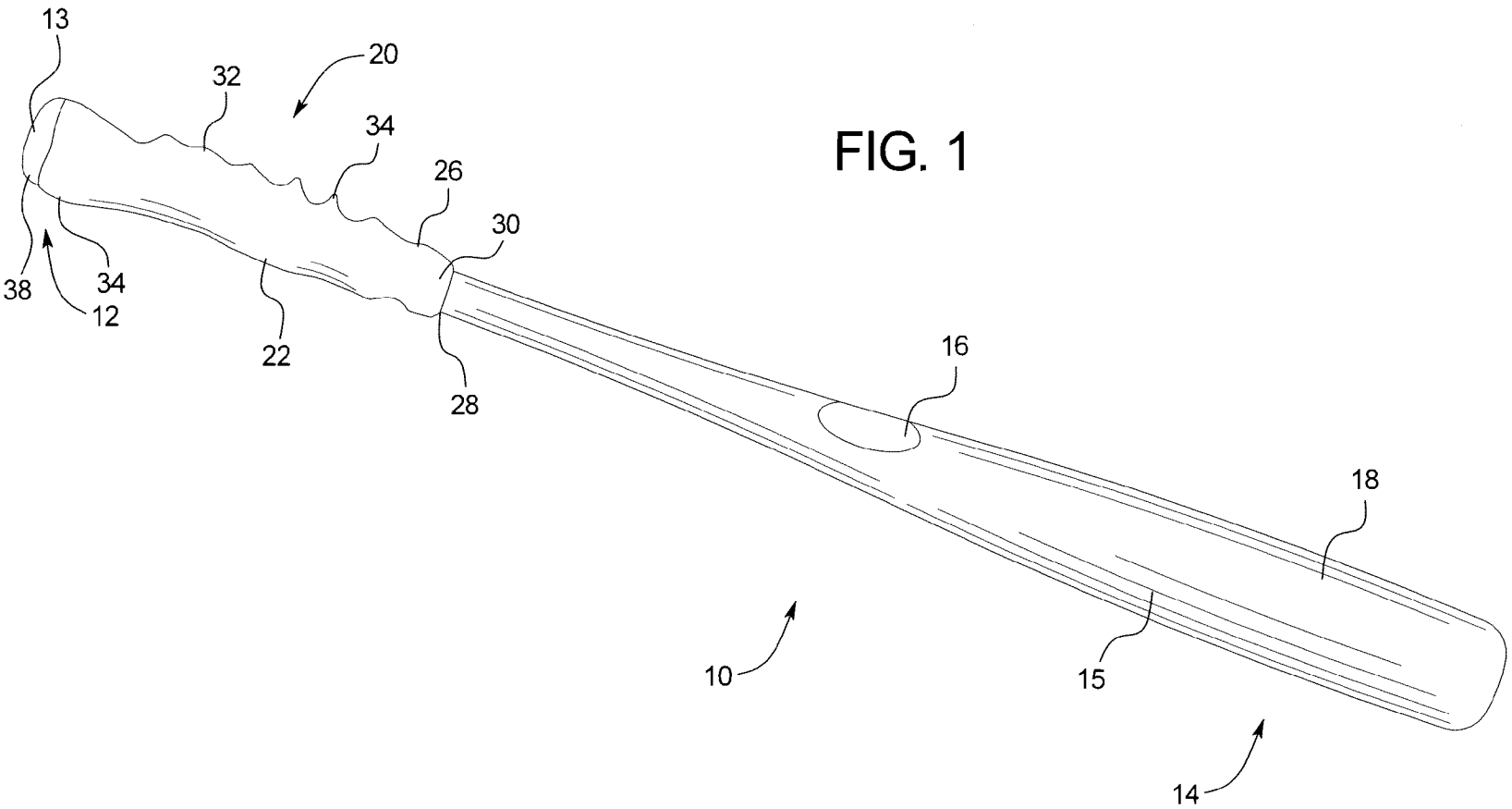
FIG. 1 is an isometric view of a baseball bat including a grip as disclosed herein, the grip including a first gripping surface, the grip shown in combination with a baseball bat.

Referring now to the drawings, and initially to FIG. 1, a piece of sporting equipment including the disclosed grip is illustrated. In the illustrated embodiment, the illustrated piece of sporting equipment is a baseball bat 10 that includes a first or proximal end 12 defining a handle 13 and a second or distal end 14 opposite the first end 12 defining a barrel 15 of the baseball bat 10. The first end 12 is substantially narrow with respect to the second end 14. The circumference of the baseball bat 10 increases from the first end 12 to the second end 14 to provide a second end 14 that comprises a maximum circumference thereby providing a striking surface for the baseball bat. In one embodiment, the baseball bat 10 is constructed from wood and is constructed in accordance with the official rules of Major League Baseball. In this embodiment, the baseball bat 10 in one embodiment is a smooth, round stick not more than 2.25 inches in diameter at the thickest part and not more than 42 inches in length. The baseball bat 10 is generally constructed from one piece of solid wood. In other embodiments, the sporting equipment with which the disclosed grip can be used includes golf clubs, tennis rackets, hockey sticks, or other appropriate elongated sporting equipment.

In the illustrated embodiment, the baseball bat includes a trademark area 16 at a point between the first end 12 and the second end 14. In this embodiment, the trademark for the baseball bat manufacturer is emblazoned on the bat at the trademark area 16. In one embodiment, the baseball bat 10 further includes a signature area 18 at a point between the trademark area 16 and the second end 14. In this embodiment, the signature area 18 includes identifying information such as the name and/or signature of the player sponsoring the particular model of the baseball bat 10. The signature area 18 is generally positioned at or near the widest portion of the baseball bat 10. In one embodiment, the trademark area 16 and signature area 18 are positioned only about a portion of the circumference of the baseball bat 10. In various embodiments, the trademark area 16 and signature area 18 are positioned one-quarter turn from the so-called sweet spot of the baseball bat 10 (i.e., the ideal spot where the ball should strike the baseball bat 10).

It should be appreciated that in embodiments of the grip disclosed herein which are configured to be used with other sporting equipment, other indicia of the sporting equipment could identify the sweet spot. For example, if the grip disclosed herein is to be used with a golf club, the shape and direction of the head of the golf club define the optimal position of the club at impact.

Figure 2:
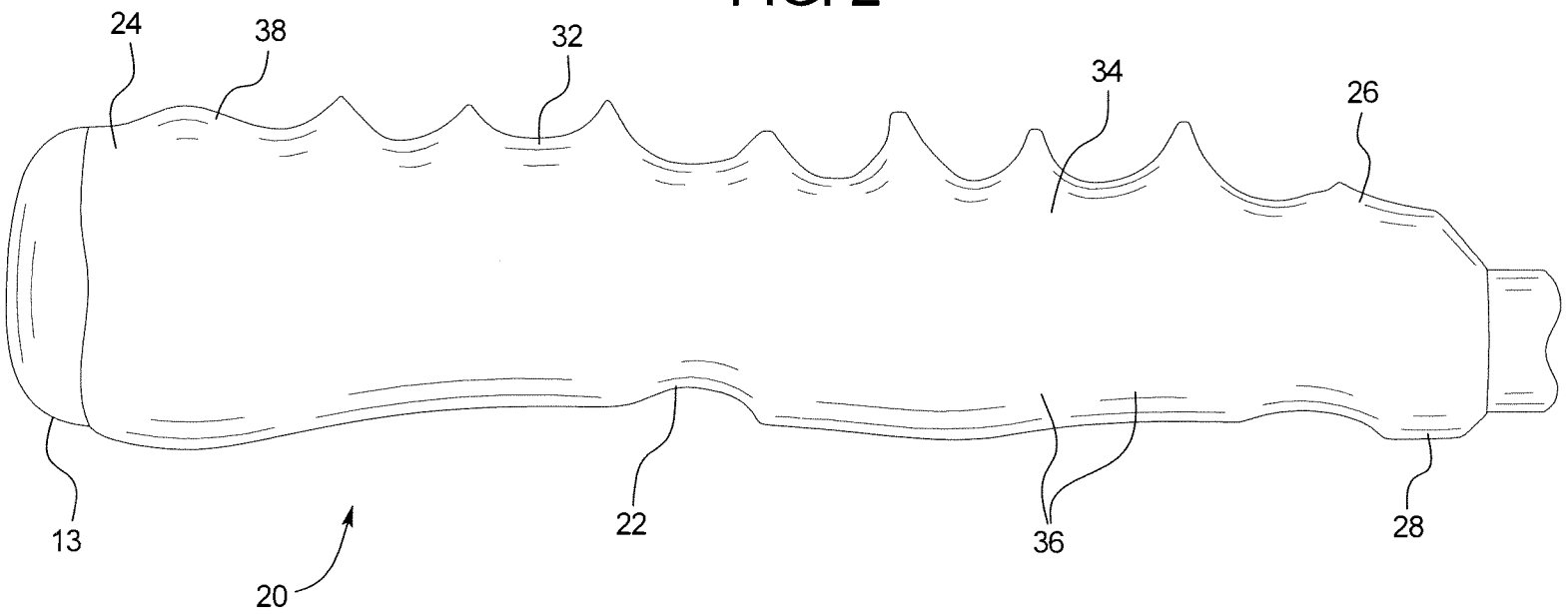
FIG. 2 is another isometric view of the grip disclosed herein, shown in combination with a baseball bat.
Figure 3:
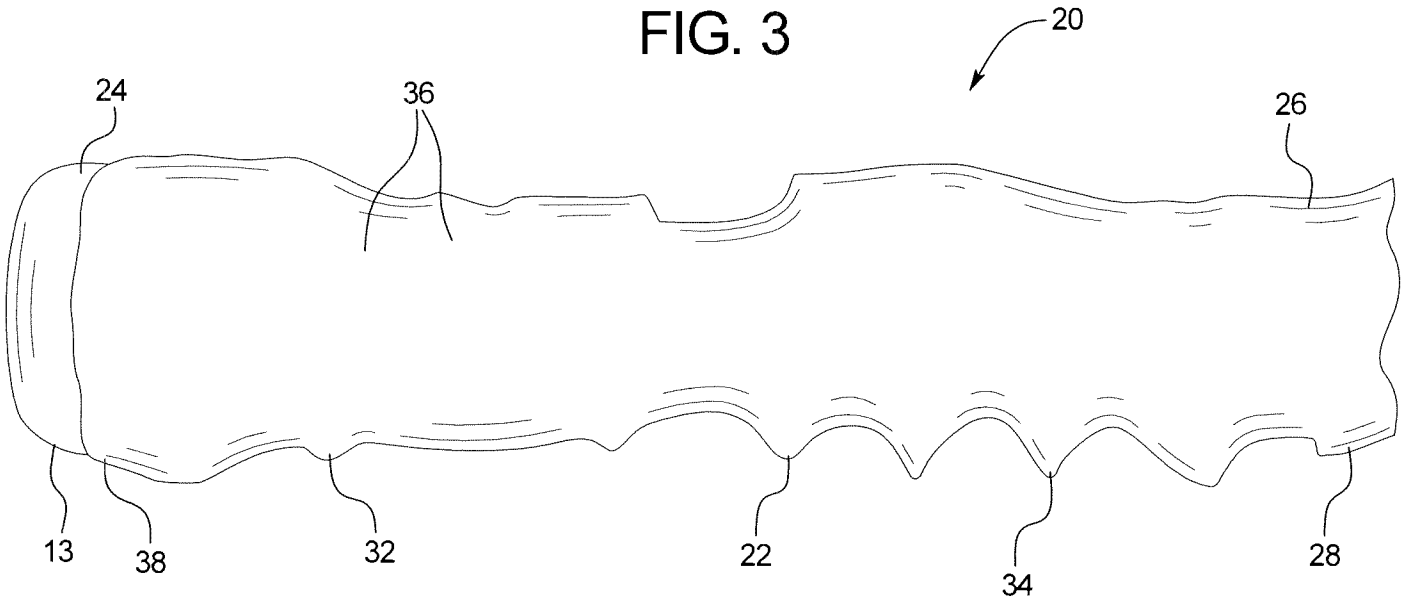
FIG. 3 is a top plan view of the grip disclosed herein, shown in combination with a baseball bat.

Referring to FIGS. 2 and 3, the first or proximal end 12 of the baseball bat 10 includes a grip 20 as disclosed herein. In one embodiment, the grip 20 includes a body 22 having a lower end 24 and upper end 26. In one embodiment, the grip 20 has a length not longer than 18 inches from the first or proximal end 12 of the baseball bat 10 (which coincides with a lower end 24 of the grip 20) to the second or distal end of the grip (e.g., to the upper end 26 of the grip 20). In one embodiment, the lower end 24 cooperates with the end of the handle 13. In one such embodiment, the lower end 24 is shaped to engage the end of the handle 13.

In the embodiment of FIG. 2, the lower end 24 of the grip 20 has a diameter equal to the diameter of the knob portion of the handle 13. In this embodiment, the lower end 24 envelopes or encompasses the knob portion of handle 13. In various embodiments, such as that illustrated in FIG. 2, the grip is sized so as to surround the portion of the handle narrower than the knob, meaning that the grip has an internal diameter that is substantially identical to the diameter of the handle of the bat. Further, the grip in these embodiments has an external diameter larger than the inner diameter, improving the user's ability to control the bat. Finally, as can seen in FIG. 2, the diameter of the lower end 24 of the grip can be larger than the diameter of the body of the grip.

In one embodiment, the upper end 26 of the body 22 of the grip 20 is positioned not further than 18 inches from the end of the handle 13. In one embodiment, the upper end 26 of the body 22 terminates in a knob 28, the knob 28 defining a stop for a user's upper hand. In the illustrated embodiment, the knob 28 is configured to cooperate with the user's hand so as to help prevent the user's hand from slipping from the grip 20. In addition, in one embodiment the knob 28 includes at least one indicating means 30 for identifying the proper orientation for positioning the grip 20 on the baseball bat 10, as will be discussed in detail below.

Further, in one embodiment, knob 28 includes or is shaped to form a pointed tip portion. In this embodiment, the pointed tip portion provides the grip with improved aerodynamics during a swing of the bat. In one embodiment, the pointed tip portion also reduces the overall weight of the grip 20, thereby improving the maximum attainable swing speed of the piece of sporting equipment. In an alternative embodiment, the pointed tip portion is rounded off to allow for easier manufacture of the grip disclosed herein.

In one embodiment of the grip 20 of the present disclosure, the pointed tip portion of the knob 28 serves as the indicating means 30. In this embodiment, the pointed tip portion generally points in a direction parallel to the axis of the barrel 15 of the baseball bat 10. In another embodiment, the indicating means 30 includes any other appropriate indicator of a proper position of the grip 20 with respect to the baseball bat 10. For example, the indicating means 30 includes a graphical indicator, an appropriately shaped portion of the knob 28, or any other suitable indicator of a proper position of the grip 20 with respect to the baseball bat 10.

In one embodiment, the grip 20 also includes a pair of weighted block areas positioned between the lower end 24 and upper end 26. In this embodiment, the weighted block areas are integral with the body 22 of the grip 20 and serve to add extra weight to the bottom of the grip 20. In one embodiment, the weighted block areas create a whip-like action during a swing of the bat, such that the whip action further propels the barrel 15 of the baseball bat 10 through a hitting zone. In one embodiment, the weighted blocks are positioned under each of the user's hands. In a further embodiment, each weighted block is positioned just below the user's fifth finger on each of the top hand and the bottom hand and extends longitudinally along the body 22 of the grip 20 toward the user's wrist. In one embodiment, the weighted blocks have a rectangular cross section. In various other embodiments, the weighted blocks have a circular cross section, a cross section defined by the shape of the user's hands, or any other appropriately shaped cross section.

In the illustrated embodiment, the body 22 of the grip 20 includes a first gripping surface 32 and a second gripping surface 34. In this embodiment, the first gripping surface 32 is positioned at a point along the baseball bat between the lower end 24 of the body 22 and the second gripping surface 34, and the second gripping surface 34 is positioned at a point between the first gripping surface 32 and the knob 28.

In one embodiment, the first gripping surface 32 is positioned and configured to receive the bottom hand of a user. That is, for a right-handed user, the first gripping surface 32 is shaped and positioned to receive the user's left hand, and for a left-handed user, the first gripping surface 32 is shaped and positioned to receive the user's right hand. In this embodiment, the second gripping surface 34 is shaped and configured to receive the user's top hand. That is, for a right-handed user, the second gripping surface 34 is shaped and configured to receive the user's right hand, and for a left-handed user, the second gripping surface 34 is shaped and configured to receive the user's left hand. In other embodiments, the first gripping surface and the second gripping surface are configured to receive the opposite hands of the user, such as if a user is using a cross-handed grip on a piece of sporting equipment.

In the illustrated embodiment, each of the gripping surfaces 32 and 34 includes a plurality of independent slots 36, one of the slots corresponding to each of the user's fingers. In one embodiment, the slots 36 include identifying information to communicate to the user the proper finger to insert into each of the slots 36. Thus, information contained on the grip 20 communicates to the user which of their fingers is to be secured into a particular slot.

In one embodiment, each of the slots 36 is sized and shaped for a particular finger. In a further embodiment, each of the slots 36 is sized and shaped for a particular finger of a particular user. In one embodiment, the slots 36 are deep enough to ensure that the user's fingers are securely received therein, thereby preventing the user's fingers from slipping out of the slots 36 during the swinging of the baseball bat 10.

In one embodiment, the first gripping surface 32 and the second gripping surface 34 are positioned such that the user's fingers are wrapped around the baseball bat 10 with the user's palms are flat against opposite sides of the handle 13. In this embodiment, the grip 20 is controlled primarily by the user's fingers, thereby providing a more controlled grip of the baseball bat 10. In one embodiment, the first gripping surface 32 and the second gripping surface 34 are relatively positioned such that the first surface 32 is one quarter-turn of the handle 13 of the baseball bat 10 away from the second gripping surface 34. Further, in one embodiment the grip 20 of the baseball bat 10 is positioned such that when the user grasps bat 10 by the grip 20, the trademark area 16 and the signature area 18 are positioned away from or opposite to the oncoming pitch. That is, in this embodiment the barrel 15 of the baseball bat 10 is positioned such that the user of the bat 10 strikes an oncoming pitch with a surface other than the trademark area 16 or signature area 18.

In one embodiment, the grip 20 includes an ergonomic heel 38 positioned at the proximal end of the body 22 of the grip 20 opposite the first gripping surface 32. That is, the ergonomic heel 38 is positioned opposite of the fingers of the user. In one embodiment, the ergonomic heel 38 is configured to prevent the baseball bat 10 from slipping from the user's fingers and entering the palm area of the user's hands. As such, the grip 20 in one embodiment includes a pushing surface for the top hand and a pulling surface for the bottom hand. Thus, the ergonomic heel 38 eliminates wasted and unintentional movement and thereby provides the user with increased bat speed and grip strength so as to better strike the ball.

In one embodiment, the body 22 of the grip 20 is constructed from a relatively elastic material, such as polyurethane. In another embodiment, the body 22 of the grip 20 is constructed from a memory-type material capable of conforming to a particular user's hand. The body 22 may be constructed from any material capable of implementing the features of the disclosed grip in accordance with the objects disclosed herein and as is generally understood in the art. In one embodiment, the body 22 is constructed from a material configured to eliminating stinging sensations experienced when the ball is struck during cold or inclement weather, off the handle 13 of the bat 10, or at the end of the barrel 15 of the bat 10, as is common. In a further embodiment, the material is configured to substantially reduce or eliminate bone bruising suffered by users, especially in the wrists, during repetitive use of a baseball bat 10. In one embodiment, the material is configured to prevent blistering and callusing of a user's hands.

In one embodiment, the grip 20 disclosed herein is customizable for a particular person's preferred grip. Accordingly, a three-dimensional mold may be taken of a user's hands, such as by taking a mold of the user's hands while gripping the baseball bat 10. In this embodiment, the resulting flexible impression is modified in accordance with the objects of the present disclosure. That is, the resulting flexible impression is configured to include each of the elements of the grip disclosed herein. In one embodiment, the flexible impression which is created results in a master pattern usable to make a mold customized to the user's preferred piece of equipment, (i.e., the user's preferred baseball bat 10). In one embodiment, the baseball bat 10 is utilized as the core of the mold. In this embodiment, a viscous form of polyurethane or similar such material is cast into the mold to produce the resulting grip 20 for attaching to the user's baseball bat 10.

Figure 4:
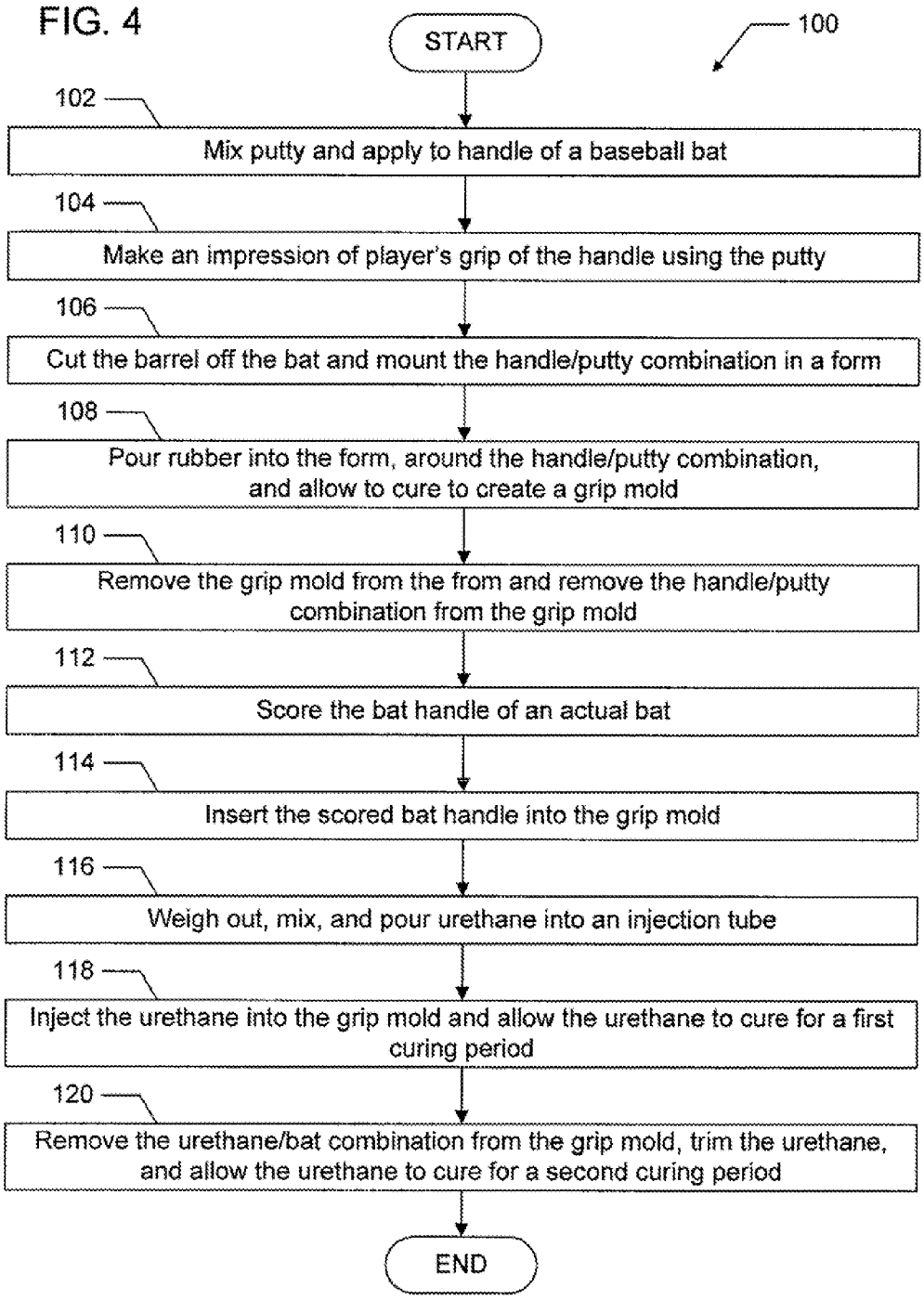
FIG. 4 is a flow chart of an example process for forming the grip around the handle of a baseball bat as disclosed herein.

More specifically, FIG. 4 illustrates a flow chart of an example process 100 for forming the grip 20 around the handle of an actual bat 10. In one embodiment, process 100 begins by mixing an appropriate putty or other moldable substance and applying the putty to the handle 13 of the baseball bat 10, as indicated by block 102. In this embodiment, wherein the grip 20 is to be customized to a particular user's hands, the putty is applied to the user's preferred baseball bat 10. In one embodiment, a sufficient amount of the putty is applied to the handle 13 of the bat 10 such that when the user grips the handle, the entire section of the bat gripped by the user is coated in putty.

In one embodiment, the user grips the handle 13/putty combination and creates an impression of the user's grip, as indicated by block 104. In this embodiment, after the user removes his or her hands from the handle 13/putty, the excess putty is trimmed from the handle 13 of the bat 10. In the illustrated embodiment, the barrel 15 of the bat 10 is sawed or cut off of the handle 13/putty combination, as indicated by block 106. In this embodiment, the handle 13/putty combination is mounted in an appropriate form, configured to receive a molding material such as rubber, as indicated by block 106. In one embodiment, after mounting the cut-off handle 13 in the form, an appropriate amount of rubber (in liquid or other viscous form) is weighted, mixed, and evacuated. The molding material is poured into the form and allowed to cure into a grip mold, as indicated by block 108 in one embodiment, the rubber is allowed to cure, such as for a twenty-four hour period.

In one embodiment, after the molding material has cured into the grip mold, the grip mold and the handle 13/putty combination are removed from the form, and the handle 13/putty combination are removed from the grip mold, as indicated by block 110. In one embodiment, the cured molding material is heated and cleaned, resulting in a finished grip mold.

In one embodiment, an additional cast (i.e., a "clean out" cast) is made of the finished grip mold. In this embodiment, the clean out cast removes any additional or extra material from the grip mold, such that subsequent casts using the grip mold result in a finished product with substantially reduced or eliminated unwanted markings or defects. In one embodiment, the clean out cast also ensures that subsequent casts contain the highest possible level of detail, such that any intricacies in the mold are transferred to the finished product.

In one embodiment, the handle of an actual bat 10, to which the grip 20 will be applied, is scored, as indicated by block 112, to ensure that the position of the grip 20 on the bat 10 does not change with use. In one such embodiment, this scoring is achieved by creating a cross-hatched pattern on the handle of the bat with a knife, saw, or other appropriately sharp scoring object. In another embodiment, the scoring is achieved through a chemical process.

After the handle 13 of the bat 10 has been appropriately scored to ensure that the grip 20 will not move with respect to the handle 13, the handle 13 of the bat 10 is inserted into the grip mold formed by the cured molding material, as indicated by block 114. In one embodiment, wherein the grip 20 disclosed herein is to be formed from urethane, the amount of urethane needed is weighed out, mixed, evacuated, and poured into an injection tube, as indicated by block 116. In one embodiment, the urethane is thereafter injected into the grip mold, and allowed to cure for a first curing period, as indicated by block 118. In one embodiment, the first curing period is an amount of time needed for the urethane to substantially set and be removed from the grip mold, such as a twenty-four hour curing period. After the first curing period, the urethane grip 20/bat 10 combination is removed from the grip mold, and the grip 20 is trimmed as appropriate, as indicated by block 120. When the grip 20 has been appropriately trimmed, it is allowed to cure for a second curing period, as indicated by block 120, such that after the second curing period, the urethane grip 20 is fully set and is formed on the handle of the bat.

It should be appreciated that the process 100 for making the grip 20, illustrated in FIG. 4, is only an example process for forming the grip 20 disclosed herein. In various embodiments, the order of one or more of the blocks is changed, or one or more of the blocks described is optional.

In one embodiment, the grip disclosed herein is formed by first creating a silicone rubber impression of a player's hands gripping the surface of a specific bat. For example, if the player is a major league baseball player, the silicone rubber impression is taken of the player gripping his own preferred baseball bat. From the impression created while the player is gripping the bat, a silicone rubber mold is created by filling a form, around the impression, with liquid, such as silicone rubber liquid. When the liquid has set, the material in the form is removed from the form and thereafter acts as a mold for creating grips. In one embodiment, the original silicone impression formed around the handle of the initial bat remains around that handle. In this embodiment, it should be appreciated that the need to destroy a bat (i.e., by sawing off the handle) is thus eliminated.

In one embodiment, for each additional bat on which the grip is desired to be disposed, the handle of the bat is scored, scuffed, or otherwise roughened such that the position of the grip, when applied to the handle of the bat, will remain static with respect to the bat. Thereafter, the mold created from the original bat is placed around the scored portion of the additional bat, and an appropriate material is injected into the mold. For example, a 30 shore A polyurethane elastomer is injected into the mold around the handle of the additional bat. After the elastomer cures, the mold is removed from the bat (i.e., the bat is de-molded), and the cured elastomer grip is trimmed as appropriate. In this embodiment, the molding process results in an exact replica of the originally formed grip.

In one embodiment, rather than applying putty or other appropriate substance directly to the handle of an actual bat and enabling a player to grasp the putty/handle combination, the grip disclosed herein is created by first constructing a mold of a bat handle alone (i.e., without a player's grip replicated thereon). After creating this replication of the bat handle alone (i.e., after the mold of the handle is created), a putty substance is applied to the mold of the handle, and the player whose grip is being created grasps the putty/mold of the handle combination, causing an impression in the putty replicating that player's grasp. After creating such a replication of the player's grasp on the mold of the handle, a second mold is formed around the replication, and an appropriate material is poured into the mold. When the material sets or forms, it is removed from the putty/mold of the handle combination, and is positioned around a handle of an actual bat. In this embodiment, the grip disclosed herein is thereafter formed from the mold as described above.

In one embodiment, the molding processes disclosed herein result in an exact replica of a particular player's grip. For example, a particular baseball player can have a silicon rubber impression taken of his hands while gripping a bat. Based on the silicon rubber impression, a mold can be formed and a plurality of identical grips can be formed around additional bat handles according to the disclosed method. In this embodiment, if a user of the bat (who is not the professional player) wishes to purchase a bat which allows replication of the professional player's grip, a grip formed from the professional player actually grasping a bat can be formed on the purchased bat, allowing the purchaser to replicate the feel and functionality of the professional player's particular grip.

It should be further appreciated that the materials disclosed as usable in the above process may be substituted for any suitable material. For example, the putty may be substituted for any suitable material for taking an impression of the player's hands, the rubber may be substituted for any suitable material for forming a grip mold, and the urethane may be substituted for any suitable material from which the grip 20 is constructed.

In one embodiment, the grip 20 of the present disclosure is intended for use as grip for use with a baseball bat 10, during live baseball action, and not merely for use as a training aid. That is, the grip 20 is designed for use in accordance with the rules of Major League Baseball. Thus, the grip 20 may be utilized during practice for instructing the user on how to properly grip the baseball bat 10, and it may also be used during actual play, thereby reducing grip errors and injuries incurred during such actual play.

It should be understood that the grip 20 of the present disclosure may be incorporated into a variety of different pieces of sporting equipment. For instance, the grip 20 may be used with tennis rackets, golf clubs, hockey sticks, or any other piece of sporting equipment having a handle that is grasped by a user thereof. It should be appreciated that the objects of the disclosed grip can apply to each such piece of sporting equipment, and that the processes described for forming the disclosed grip can also apply to each such piece of sporting equipment.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A grip for a piece of sporting equipment, the piece of sporting equipment having a first proximal end including a handle portion and a knob and a second distal end opposite the first proximal end, the second distal end including a striking surface, the grip comprising:

a body including:

an external portion having a first diameter, a first gripping surface, and a second gripping surface, wherein:

the second gripping surface is positioned one-quarter turn from the first gripping surface, and the first gripping surface and the second gripping surface each include a plurality of slots shaped to receiving a plurality of fingers of a user, the slots having a depth sufficient to secure the user's fingers therein, an internal portion having a second diameter sized to fixedly engage the handle portion of the piece of sporting equipment, a proximal portion having a third diameter which is larger than the first diameter of the external portion, the proximal portion positioned proximal to the first gripping surface and at least partially enveloping the knob of the handle portion of the piece of sporting equipment such that the third diameter is equal to a diameter of the knob of the piece of sporting equipment, and a knob positioned at a distal portion of the body configured to prevent slipping of the user's hand from the grip.

2. The grip of claim 1, wherein the knob includes an indicating means for indicating proper positioning of the grip with respect to a predetermined portion of the piece of sporting equipment.

3. The grip of claim 2, wherein the proper positioning of the grip with respect to the predetermined portion of the piece of sporting equipment is based on a desired position of the striking surface.

4. The grip of claim 1, wherein at least one of the slots includes indicia on a surface of the at least one slot for identifying which of the user's fingers are to be received by the at least one slot.

5. The grip of claim 1, wherein the proximal portion of the body is shaped to engage a proximal portion of the piece of sporting equipment.

6. The grip of claim 5, wherein the proximal portion of the piece of sporting equipment includes a knob of the piece of sporting equipment having a larger diameter than a diameter of the handle portion of the piece of sporting equipment.

7. The grip of claim 1, wherein the piece of sporting equipment is at least one selected from the group consisting of: a baseball bat, a golf club, a tennis racket, and a hockey stick.

8. A piece of sporting equipment comprising a body having a first proximal end and a second distal end, the first proximal end including the grip of claim 1.

* * * * *